US005389228A

United States Patent [19]

Long et al.

[11] Patent Number: 5,389,228

[45] Date of Patent: Feb. 14, 1995

[54] BRUSH PLATING COMPRESSOR BLADE TIPS

[75] Inventors: Kenneth C. Long, Stuart; Brian A. Manty, Palm Beach Gardens; Charles C. McComas, Palm City, all of Fla.

[73] Assignee: United Technologies Corporation, Hartford, Conn.

[21] Appl. No.: 13,283

[22] Filed: Feb. 4, 1993

[51] Int. Cl.[6] ..... C25D 5/06

[52] U.S. Cl. ..... 205/110; 205/117; 205/181

[58] Field of Search ..... 205/109, 110, 114, 117, 205/181

[56] References Cited

U.S. PATENT DOCUMENTS

| | | | |
|---|---|---|---|
| 2,391,206 | 12/1945 | Van Der Pyl | 205/110 X |
| 3,980,549 | 9/1976 | Grutza | 205/110 |
| 4,169,020 | 9/1979 | Stalker et al. | 204/16 |
| 4,608,128 | 8/1986 | Farmer et al. | 204/16 |
| 4,655,881 | 4/1987 | Tezuka et al. | 204/15 |
| 4,735,656 | 4/1988 | Schaefer et al. | 75/238 |
| 4,738,756 | 4/1988 | Mseitif | 204/15 |
| 4,802,828 | 2/1989 | Rutz et al. | 416/241 B |
| 4,851,188 | 7/1989 | Schaefer et al. | 419/19 |
| 5,074,970 | 12/1991 | Routsis et al. | 205/122 |
| 5,076,897 | 12/1991 | Wride et al. | 205/110 |

OTHER PUBLICATIONS

Metal Finishing Guidebook and Directory For 1975, Metals and Plastics Publications, Inc., Hackensack, N.J., pp. 394–402.

*Primary Examiner*—John Niebling
*Assistant Examiner*—William T. Leader
*Attorney, Agent, or Firm*—Herbert W. Mylius

[57] ABSTRACT

A method is taught for application of an abrasive tip to a gas turbine blade by brush plating, wherein particulate abrasive is applied to the tip of said blade and held in position during electroplating by a porous dielectric cloth.

18 Claims, No Drawings

BRUSH PLATING COMPRESSOR BLADE TIPS

BACKGROUND OF THE INVENTION

1. Field of the Invention

This invention relates to a method for making a component of a gas seal structure for a gas turbine engine. More particularly, the invention relates to a method for depositing a layer having abrasive characteristics onto the surface of a turbine blade using a brush plating technique.

2. Description of the Prior Art

In the compressor and turbine sections of gas turbine engines, blades rotate about the axis of the engine. The blade tips come in proximity to the inner wall of the engine case, frequently rubbing the case wall, or an abradable seal coated on the case wall. Engine efficiency depends to a significant extent upon minimizing leakage by control of the gas flow in such a manner as to maximize interaction between the gas stream and the moving and stationary blades. A major source of inefficiency is leakage of gas around the tips of the compressor blades, between the blade tips and the engine case. In view of the growing competition in the gas turbine business, the emphasis on closer tolerances, and thus greater efficiencies, is increasing. Although a close tolerance fit may be obtained by fabricating the mating parts to a very close tolerance range, this fabrication process is extremely costly and time consuming. Further, when the mated assembly is exposed to a high temperature environment and high stress, as when in use, the coefficients of expansion of the mating parts may differ, thus causing the clearance space to either increase or decrease. The latter condition would result in a frictional contact between blades and housing, causing elevation of temperatures and possible damage to one or both members. On the other hand, increased clearance space would permit gas to escape between the turbine blade and housing, thus decreasing efficiency.

One means to increase efficiency is to apply a coating of suitable material to the interior surface of the compressor housing, to reduce leakage between the blade tips and the housing. Various coating techniques have been employed to coat the inside diameter of the turbine housing with an abradable coating which can be worn away by the frictional contact of the turbine blade, to provide a close fitting channel in which the blade tip may travel. Thus, when subjecting the coated turbine assembly to a high temperature and stress environment, the blade and the case may expand or contract without resulting in significant gas leakage between the blade tip and the turbine housing. This abradable coating technique has been employed to not only increase the efficiency of the compressor, but to also provide a relatively speedy and inexpensive method for restoring excessively worn turbine engine parts to service.

To extend the life of the blade tips which rub against the abradable seals, abrasive layers are sometimes applied to the blade tip surface by a variety of methods. See, for example, U.S. Pat. 4,802,828, of Rutz et al, which mentions several techniques for providing the abrasive layer on a blade tip, including powder metallurgy techniques, plasma spray techniques, and electroplating techniques; Schaefer et al, U.S. Pat. No. 4,735,656, which teaches application of an abrasive comprising ceramic particulates in a metal matrix by controlled melting and solidification of the matrix metal; or Schaefer et al, U.S. Pat. No. 4,851,188 which teaches a sintering operation for application of an abrasive layer to the tip of a superalloy gas turbine blade.

Electroplating techniques have been previously used for the deposition of abrasive layers to blade tips, as illustrated in Routsis, et al, U.S. Pat. No. 5,074,970, which teaches entrapment of nonconductive particulates within a layer of nickel upon the surface of a compressor blade by submerging the blade tip in a slurry of the particulate in plating solution, and electroplating a layer of nickel about the particulates in contact with the blade tip surface to encapsulate them in place. Similarly, U.S. Pat. No. 4, 608,128, of Farmer et al, relates to deposition of nonconductive particulates on a substrate by applying a nonconductive tape carrying the particles to the blade tip, and electrodeposition of a metallic coating through pores in the tape onto the blade surface and about the abrasive particles, followed by removal of the tape so as to leave the particles on the blade surface, held in place by the electrodeposited metallic coating.

In Stalker et al, U.S. Pat. No. 4,169,020, an abrasive tip is produced by electrodepositing the metal matrix while concurrently entrapping abrasive particles included in the electroplating solution. In this reference, particles are deliberately left protruding from the matrix by limiting the matrix thickness. Wride et al, in U.S. Pat. No. 5,076,897, teach application of a binding coat on the tip of a blade body by electrodeposition, followed by composite electrodeposition of particulate abrasive and an anchoring metal matrix, followed by plating an infill around the abrasive particles.

Brush plating techniques have been taught for the application of various metals to conductive surfaces. For example, Tezuka et al, in U.S. Pat. No. 4,655,881, teach the use of a liquid retaining material, such as a woven fabric, on an anode surface designed to plate opposed parts of a fork-like terminal. In U.S. Pat. No. 4,738,756, Mseitif teaches brush chrome plating using a tank chrome plating solution, rather than more expensive brush plating solutions having higher metal ion concentrations. The Mseitif reference teaches the use of a dielectric porous anode cover.

SUMMARY OF THE INVENTION

The present invention utilizes brush plating to apply an abrasive coating to compressor or turbine blade tips, whereby particulate abrasive, such as cubic boron nitride, is trapped within the plated metal so as to provide an abrasive surface. The present application is of particular value in application of abrasive blade tip materials to integrally bladed rotors, since immersion of the entire rotor in a plating tank is not required. It is an object of the present invention to provide a method for the preparation of abrasive blade tips for compressors by use of a brush plating technique. It is a further object of the invention to provide a less costly method for the application of blade tip coatings without extensive masking of the blade, at high coating rates, and with minimal generation of hazardous waste.

DESCRIPTION OF THE PREFERRED EMBODIMENTS

The current process for application of abrasive blade tips to compressor blades comprises immersing individually masked blade tips into a conventional plating tank containing a nickel plating solution, and dipping the tip in a concentrated slurry of particulate abrasive grit, such as is taught in U.S. Pat. No. 5,074,970 of Routsis et al. The process of said patent involves the electroplating deposition of a plurality of nickel layers upon a titanium alloy blade tip, each layer being chemically bonded to the layer adjacent to it, while entrapping but not encapsulating the abrasive particulates. In accordance with the present invention, a conventional brush plating apparatus may be used to electroplate a metal matrix onto a metal blade substrate, using specially formulated plating solutions containing greater metal concentrations than conventional tank electroplating solutions. Particulate abrasive is placed on the blade tip prior to electroplating, and held in place during brush plating by a porous cloth or felt. The porous cloth allows the passage of electrodeposition current and electrolyte from the plating brush to the blade tip, while retaining the particulate in position so as to be entrapped by the metal matrix as it is deposited on the blade tip.

Conventional brush plating processes are used to electroplate various metal coatings on a variety of conductive substrates. In such processes, a brush plating solution is flowed through an anodic brush which is in constant motion against the surface to be plated, which is normally the cathode. The brush is normally constructed of a graphite anode connected to an insulating hollow handle, with the graphite being covered by a porous, flexible, dielectric material, such as a nonwoven fabric. In operation, the plating solution is maintained at the desired temperature by heating means, and pumped to the plating brush, where it enters the hollow handle, and passes through an opening in the graphite anode and saturates the porous dielectric covering material. The applicator is passed over the part to be plated, which is connected to the power source as the cathode, as the power supply maintains the desired voltage and current to generate the proper current density for sufficient time to obtain the desired plating thickness. Excess plating solution is collected in a return tray, and recirculated to the pump.

The present invention is specifically designed for the application of abrasive materials to nickel base alloy or steel alloy blades, such as are conventionally used in the compressors of gas turbine engines. However, the process may also be used to apply abrasive material to blade tips of various high temperature superalloy compositions, such as cobalt-based alloys or titanium alloys. While cubic boron nitride is the preferred abrasive material, other suitable particulate abrasives may be employed, such as alumina, zirconia, silicon carbide, and various nitrides, carbides, silicides, and borides known from the abrasive arts. The abrasive may have a particle size of from about 40 to about 180 microns, preferably from about 88 to about 105 microns. The particulates should have an irregular surface texture to maximize abrasive characteristics and entrapment by the electrodeposited matrix metal. Electrically conductive particulates, such as SiAlON, are not suitable for the present invention.

The matrix metal, applied by electrodeposition using the brush plating process described herein, may comprise cobalt, platinum, chromium, nickel, or an alloy of nickel with tungsten or cobalt. Machinable nickel brush plating solutions are preferred for use in the present invention.

The brush covering material, separating the anode from the cathodic blade tip, may be any dielectric, porous material, such as a woven fabric or cloth of cotton, nylon, polyester, or blends thereof, a felt like material, a commercially available brush plating cover such as Scotchbrite fibrous pads, a product of 3M Company, or a plastic mesh cover of such materials as Kevlar polyaramid, available from DuPont, nylon cloths of various weaves, and cotton cloth.

The basic process of the present invention employs conventional cleaning and preparation steps, including degreasing, grit blasting, and etching of the blade tip surface prior to application of the electrodeposit. A nickel strike layer is applied as appropriate, followed by application of the particulate abrasive material to the blade tip surface. This may be accomplished conveniently by generously sprinkling the powdered abrasive over the tip, by dipping the tip in a slurry of powder in a suitable carrier, by dipping the tip in dry powder, or by brushing the powder, in a carrier such as water, on the surface. The blade is then positioned in the plating rig, and connected to the power source, preferably at the blade root. Alternatively, of course, the blade may be positioned in the plating rig and connected to the power source prior to application of the particulate abrasive. A suitably sized piece of cloth, such as cotton or nylon, having a porosity such as to permit flow of plating solution through the cloth while not permitting movement of the abrasive powder, is wet with deionized water and placed over the blade tip in such a position as to hold the abrasive powder in place during plating. The anodic brush is then placed in physical contact with the thus covered blade tip, with electrical insulation provided by the dielectric, porous brush cover. Electrodeposition of the metal from the plating solution is then conducted in conventional fashion, with plating solution being pumped through the plating brush, and the plating temperature and current density being regulated appropriately. After a period of deposition such as to apply a metal layer sufficient to embed the particulate abrasive to a depth of approximately 20 to 50 percent, preferably about 30 percent, of its nominal diameter, dependent upon particle diameter, plating is suspended while the cover cloth is removed from the blade tip, additional abrasive is placed on the partially plated blade tip to fill any areas of insufficient abrasive content, and a new cover cloth, wet with deionized water or plating solution, is placed over the newly applied abrasive powder so as to hold it in place. The anode of the brush plating apparatus is then returned, and additional metal is deposited over the newly deposited abrasive powder, for sufficient time to embed the powder to a depth of from about 60 to about 95 percent, and preferably about 80 percent of its nominal size. This procedure of suspending plating, removing the cover cloth, and applying additional abrasive powder may be repeated as many times as appropriate to achieve the desired abrasive layer thickness. A final plating of metal may be applied absent the covering cloth to further embed the particulate abrasive. While this final surface metal will normally be of the same metal as the matrix metal, other metals capable of being brush plated may also be used if desired. A total abrasive thickness of from about 0.002 inches to about 0.010 inches may be applied, preferably from about 0.005 to about 0.006 inches, dependent upon nominal particle diameter. During plating, the current may be periodically reversed, so as to improve uniformity of the coating deposit.

When applying an abrasive layer to the tip of a titanium alloy blade, a diffusion layer may be applied to the blade tip prior to application of the abrasive, so as to prevent diffusion of the electroplated nickel into the titanium alloy. Suitable materials such as platinum, tungsten, chromium, palladium, or other metals or alloys, may be applied as diffusion layers to decrease or prevent fatigue degradation of the titanium alloy blade at elevated temperatures during use.

EXAMPLE 1

An abrasive coating was applied to Inco 901 nickel alloy rub rig blade tips in accordance with the present invention. A flow through anode of graphite was employed, wrapped with Scotchbrite White porous pad, and covered with Kevlar #108 plastic cloth. The blade tip was degreased with acetone, grit blasted with 240 grit aluminum oxide, and anodically etched for one minute at 0.05 amps in an aqueous solution of 25 volume percent sulfuric acid and 4.5 volume percent hydroflouric acid. After rinsing in deionized water, a nickel strike was then applied by electroplating with Wood's nickel strike solution for three minutes at 0.06 amps. The blade was then rinsed again in deionized water, before a water slurry of cubic boron nitride powder, having a nominal powder size of about 95 microns, was applied generously to the tip with a small paint brush. The blade was then positioned in a plating fixture, with the tip up, and with electrical contact made at the blade root. A piece of cotton glove material, cut slightly larger than the blade tip, was thoroughly wet with deionized water, and placed over the blade tip so as to hold the abrasive powder in place. The anode was then lowered onto the blade tip, and the current set at 0.12 amps. After about 20 seconds, the plating solution pump was activated, and Selectron's SPS 5715 plating solution, a machinable nickel plate, at a temperature of about 140° to 150° F., was deposited upon the blade tip for eight minutes. The plating was then discontinued, and the anode lifted while the cotton cloth was removed from the blade tip. After filling in void areas with additional cubic boron nitride, a new cotton cloth, wet with deionized water, was applied over the blade tip, and the anode was lowered to continue electroplating for another eight minutes. The anode was again lifted, additional abrasive powder was applied to the blade tip, another cotton cloth was applied, and plating was continued for another eight minutes. The anode was then lifted, the cloth removed, and a final nickel layer was electroplated onto the structure for about 5 minutes. This resulted in a blade tip coating thickness of approximately 0.005 inches, with a uniform distribution of abrasive in the nickel plate. Subsequent rub rig testing of the blade tip coating into abradable seal material showed identical results to those of blade tips prepared by conventional CBN blade tip tank plating methods.

EXAMPLE 2

An abrasive coating was applied to a titanium alloy rub rig blade tip in accordance with the present invention. A flow through anode of graphite was employed, wrapped with Scotchbrite White fibrous pad, and covered with Kevlar #108 plastic cloth. The blade tip was degreased with acetone, grit blasted with 240 grit aluminum oxide, and immersed in concentrated hydrochloric acid for about two minutes, after which it was anodically etched in Wood's nickel strike for 30 seconds at 0.06 amps. Without removing the part from the strike solution, current was reversed and the blade tip was plated for three minutes at 0.06 amps to produce a thin nickel coating layer. The blade was then rinsed in deionized water, before a water slurry of cubic boron nitride powder, having a nominal powder size of about 95 microns, was applied generously to the tip with a small paint brush. The blade was then positioned in a plating fixture, with the tip up, and with electrical contact made at the blade root. A piece of nylon glove material, cut slightly larger than the blade tip, was thoroughly wet with deionized water, and placed over the blade tip so as to hold the abrasive powder in place. The anode was then lowered onto the blade tip, and the current set at 0.12 amps. After about 15 to 30 seconds, the plating solution pump was activated, and Selectron's SPS 5715 plating solution, a machinable nickel plate, at a temperature of about 140° to 150° F., was deposited upon the blade tip for eight minutes. The plating was then discontinued, and the anode lifted while the nylon cloth was removed from the blade tip. After filling in void areas with additional cubic boron nitride, a new nylon cloth, wet with deionized water, was applied over the blade tip, and the anode was lowered to continue electroplating for another eight minutes. The anode was again lifted, additional abrasive powder was applied to the blade tip, another nylon cloth was applied, and plating was continued for another eight minutes. The anode was then lifted, the cloth removed, and a final nickel layer was electroplated onto the structure for about 5 minutes. The final thickness of the blade tip coating was about 0.005 to about 0.006 inches, with the abrasive particulate evenly distributed therein.

It is to be noted that the present invention permits application of abrasive blade tips to suitable metal airfoils with minimal generation of hazardous wastes, since brush plating requires much smaller volumes of electroplating solution than bath plating, and since the plating solutions may be readily controlled and recirculated with minimal loss to evaporation. Further, the invention permits application of abrasive tips to integrally bonded rotors, which presents great difficulty using plating tank technology. Further, the process may be readily automated, with brush type fixtures which fit tightly about the blade tips, allowing plating solution flow while ensuring entrapment of the abrasive particles.

It is to be understood that the above description of the present invention is subject to considerable modification, change, and adaptation by those skilled in the art to which it pertains, and that such modifications, changes, and adaptations are to be considered within the scope of the present invention, which is set forth by the appended claims.

What is claimed is:

1. A method for the application of an abrasive tip to a gas turbine blade, said method comprising the steps of:

a) providing a blade body having a tip;

b) cleaning said tip and applying thereto a nickel strike;

c) applying to said tip a loose coating of particulate abrasive;

d) connecting said blade body to a power source;

e) covering said particulate abrasive with a dielectric cloth or fabric, said cloth or fabric being porous to plating solution while not permitting movement of the particulate abrasive;

f) brush electroplating a metal selected from the group consisting of cobalt, platinum, chromium, nickel, nickel-tungsten alloys, and nickel-cobalt alloys onto said blade tip in such a manner as to embed said particulate abrasive in said metal;

g) removing said dielectric cloth; and h) brush electroplating a surface layer of said metal over the embedded abrasive.

2. A method as set forth in claim 1, wherein said blade comprises a metal selected from the group consisting of nickel based, steel based, cobalt based, and titanium based alloys.

3. A method as set forth in claim 2, wherein said particulate abrasive is selected from the group consisting of alumina, zirconia, silicon carbide, cubic boron nitride, silicides, nitrides, borides, and carbides.

4. A method as set forth in claim 3, wherein said electroplating metal is selected from the group consisting of nickel, nickel-tungsten alloys, and nickel-cobalt alloys, and steps c, e, f, and g are carried out a plurality of times.

5. A method as set forth in claim 3, wherein said abrasive is cubic boron nitride, and said blade is selected from the group consisting of nickel based alloys and titanium based alloys.

6. A method as set forth in claim 5, further comprising the step of applying a diffusion layer to the blade prior to applying said particulate abrasive, and wherein said blade comprises a titanium based alloy.

7. A method as set forth in claim 5, wherein said electroplated metal comprises nickel, and said blade comprises a nickel based alloy.

8. A method as set forth in claim 7, wherein said electroplated nickel and said cubic boron nitride form an abrasive tip coating of from about 0.002 to about 0.010 inches thick.

9. A method as set forth in claim 8, wherein said nickel covers said cubic boron nitride to a depth of from about 60 to about 95 percent of its nominal diameter.

10. A method for applying an abrasive blade tip to a blade of a gas turbine engine, said method comprising the steps of:

a) providing a blade body having a tip;

b) preparing said tip for electroplating;

c) applying to said tip an unbonded coating of particulate abrasive selected from the group consisting of alumina, zirconia, silicon carbide, and cubic boron nitride;

d) restricting movement of said particulate abrasive by applying thereto a covering comprising a dielectric fabric which is porous to plating solution;

e) applying a metal selected from the group consisting of cobalt, platinum, chromium, nickel, nickel-tungsten alloys, and nickel-cobalt alloys to said blade tip by brush electroplating;

f) removing said covering; and g) applying a surface layer of a metal selected from the group consisting of cobalt, platinum, chromium, nickel, nickel-tungsten alloys, and nickel-cobalt alloys over said abrasive so as to cover from about 60 to about 95 percent of the nominal diameter of said abrasive.

11. A method as set forth in claim 10, wherein said blade body comprises a metal selected from the group consisting of nickel based, steel based, cobalt based, and titanium based alloys.

12. A method as set forth in claim 11, wherein said applied metal comprises nickel, and said steps c, d, e, and f are carried out a plurality of times to achieve the desired thickness of abrasive coating.

13. A method as set forth in claim 12 wherein said desired thickness is from about 0.002 to about 0.010 inches.

14. A method as set forth in claim 13, wherein said particulate abrasive is cubic boron nitride having a nominal diameter of from about 40 to about 180 microns.

15. A method as set forth in claim 14, wherein said blade body comprises a nickel based alloy.

16. A method as set forth in claim 15, wherein said cubic boron nitride has a nominal diameter of from about 88 to about 105 microns.

17. A method as set forth in claim 16, wherein said desired thickness is from about 0.005 to about 0.006 inches.

18. A method as set forth in claim 14, wherein said blade body comprises a titanium based alloy, and a diffusion layer is applied to the blade prior to application of said particulate abrasive.

* * * * *